US005413479A

United States Patent [19]

Nakanishi et al.

[11] Patent Number: 5,413,479

[45] Date of Patent: May 9, 1995

[54] DISCHARGE-TYPE IGNITION DEVICE FOR OIL BURNER

[75] Inventors: Yutaka Nakanishi, Kounan; Toshihiko Yamada, Anjou; Toru Nakagaito, Nagoya, all of Japan

[73] Assignee: Toyotomi Company, Ltd., Aichi, Japan

[21] Appl. No.: 187,318

[22] Filed: Jan. 27, 1994

[30] Foreign Application Priority Data

Jan. 29, 1993 [JP] Japan ..... 5-034343
Jan. 29, 1993 [JP] Japan ..... 5-034344

[51] Int. Cl.[6] ..... F23D 3/28

[52] U.S. Cl. ..... 431/304; 431/255; 431/257; 431/315; 126/96

[58] Field of Search ..... 431/304–307, 431/254–257, 315, 308, 259, 263, 320, 344; 126/96, 95

[56] References Cited

U.S. PATENT DOCUMENTS 4,422,845 12/1983 Yamaguchi ..... 431/307
4,486,170 12/1984 Tsukada et al. ..... 431/304
5,030,085 7/1991 Yamada et al. ..... 126/96

FOREIGN PATENT DOCUMENTS 47-32647 10/1972 Japan .
54-448 1/1979 Japan .
54-26901 9/1979 Japan .
63-35244 9/1988 Japan .
347340 4/1931 United Kingdom ..... 431/257

*Primary Examiner*—James C. Yeung
*Attorney, Agent, or Firm*—Pollock, Vande Sande & Priddy

[57] ABSTRACT

A discharge-type ignition device for an oil burner capable of permitting ignition of a wick to be carried out at any optimum position of the wick which is fixed. First and second discharge electrodes are arranged in proximity to the wick when it is raised to a combustion position. An ignition switch is kept turned on in the course of upward movement of the wick for ignition, so that spark discharge is generated between the discharge electrodes toward the wick being raised. The wick is raised to an uppermost position beyond the combustion position every time when the ignition operation is carried out, so that ignition may take place at any optimum position of the wick.

18 Claims, 9 Drawing Sheets

DISCHARGE-TYPE IGNITION DEVICE FOR OIL BURNER

BACKGROUND OF THE INVENTION

This invention relates to a discharge-type ignition device for an oil burner, and more particularly to a discharge-type ignition device for an oil burner which is adapted to carry out ignition of a wick of the oil burner by electric discharge.

Conventionally, a filament-type ignition device for an oil burner which is constructed so as to red-heat a filament by means of a dry cell acting as a power supply, to thereby permit the red-heated filament to ignite a wick of the oil burner is generally used for ignition of the oil burner.

Further, a discharge-type ignition device for an oil burner is also known in the art. The discharge-type ignition device is classified into a device using combustion heat generated from the oil burner as a heat source and a commercial AC 100 V power supply as a power supply for the ignition device and a device using a battery means such as a dry cell as the power supply.

The latter discharge-type ignition device using a battery as the power source for electric or spark discharge is disclosed in Japanese Utility Model Publication No. 35244/1988, although it unfortunately fails to be put into practice due to various disadvantages. The conventional discharge-type ignition device using a battery as disclosed includes discharge electrodes arranged so as to be spaced from each other with a combustion wick being interposedly positioned therebetween.

The present invention is directed to a discharge-type ignition device of the latter type which uses a battery as a power supply to carry out spark discharge between discharge electrodes, to thereby ignite a wick.

The conventional discharge-type ignition device using a dry cell as the power supply has a disadvantage that the dry cell fails to permit spark discharge sufficient for ignition of a wick of an oil burner to occur between discharge electrodes. Also, the conventional discharge-type ignition device using a dry cell causes a variation in height of the wick and deterioration of a surface of the wick due to settling of the wick, adhesion of tar to the wick or the like, and deformation of the wick with lapse of time, resulting in a variation in dimension between the wick and the discharge electrodes. This causes spark generated by discharge to be deviated from the wick, leading to a failure in ignition of wick and/or generation of white fume of fuel oil from the wick. This would be the reason why the conventional discharge-type ignition device using a dry cell fails to be put into practice.

Thus, an ignition device for an oil burner which is currently commercially available is limited to the above-described filament-type ignition device.

Accordingly, it is highly desirable to develop a discharge-type ignition device using a battery such as a dry cell which eliminates the above-described disadvantage of the prior art, because it is essentially free of a disadvantage of a filament-type ignition device that a filament is readily exhausted, deformed and/or broken.

SUMMARY OF THE INVENTION

The present invention has been made in view of the foregoing disadvantage of the prior art.

Accordingly, it is an object of the present invention to provide a discharge-type ignition device for an oil burner which is capable of generating spark discharge in the course of upward movement of a wick for ignition of the wick, to thereby ensure positive and effective ignition of the wick irrespective of using of a dry cell.

It is another object of the present invention to provide a discharge-type ignition device for an oil burner which is capable of positively accomplishing ignition of a wick irrespective of a variation in height of the wick, deterioration of the wick, deformation of the wick and the like.

It is a further object of the present invention to provide a discharge-type ignition device for an oil burner which is capable of positively carrying out ignition of a wick by spark discharge.

It is still another object of the present invention to provide a discharge-type ignition device for an oil burner which is capable of effectively accomplishing ignition of a wick even when spark discharge for the ignition is weak, to thereby permit a small-sized power supply such as a dry cell to be used for the spark discharge.

It is even another object of the present invention to provide a discharge-type ignition device for an oil burner which is capable of preventing a human body such as a hand, a finger or the like from carelessly touching a discharge electrode means during cleaning of the ignition device or the like.

It is a still further object of the present invention to provide a discharge-type ignition device for an oil burner which is capable of keeping a distance between a discharge electrode means and a wick substantially constant, to thereby ensure smooth ignition of the wick.

It is a yet further object of the present invention to provide a discharge-type ignition device for an oil burner which is capable of effectively preventing a side wind blowing against the oil burner from adversely affecting both ignition operation and combustion operation.

It is an even further object of the present invention to provide a discharge-type ignition device for an oil burner which is capable of being simplified in construction, leading to a decrease in manufacturing cost.

In accordance with the present invention, a discharge-type ignition device for an oil burner is provided. The discharge-type ignition device comprises a wick receiving cylinder structure including an inner cylindrical member and an outer cylindrical member arranged so as to be spaced from each other with a space being defined therebetween, a wick arranged in the space of the wick receiving cylinder structure so as to be vertically movable, a wick operating shaft rotated for vertically moving the wick, a discharge electrode means including a fist discharge electrode and a second discharge electrode which are arranged for generating spark discharge therebetween sufficient to ignite a portion of the wick raised so as to upwardly extend from the space of the wick receiving cylinder structure, an ignition knob for rotating the wick operating shaft in a wick raising direction, and an ignition switch operated depending on actuation of the ignition knob. The ignition switch is turned off when the ignition knob is moved to a wick lowered position and turned on in the course of upward movement of the wick and the discharge electrode means carries out spark discharge in the course of upward movement of the wick.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENTS

Now, a discharge-type ignition device for an oil burner according to the present invention will be described hereinafter with reference to the accompanying drawings.

Figure 1:
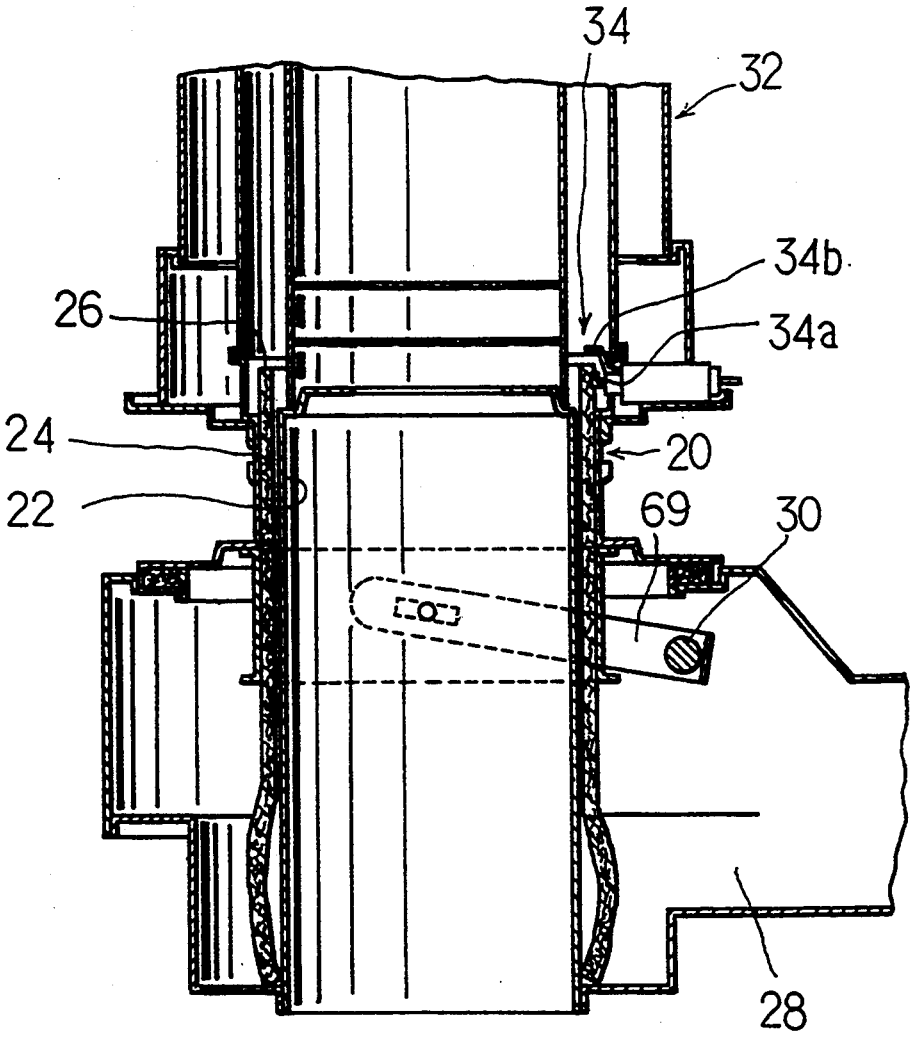
FIG. 1 is a vertical sectional view showing an example of an oil burner to which a discharge-type ignition device according to the present invention is applied.

Referring first to FIG. 1, an example of an oil burner to which a discharge-type ignition device according to the present invention may be applied is illustrated. The oil burner shown in FIG. 1 includes a wick receiving cylinder structure 20 comprising an inner cylindrical member 22 and an outer cylindrical member 24 arranged so as to be radially spaced from each other with a space being defined therebetween. In the thus-formed space of the wick receiving cylinder structure 20 is arranged a wick 26 in a manner to be vertically movable. The wick receiving cylinder structure 20 is mounted on an oil reservoir 28. Reference numeral 30 designates a wick operating shaft, which is adapted to vertically move the wick 26 when it is rotated. On the wick receiving cylinder structure 20 is supported a combustion cylinder structure 32 in which combustion of fuel oil takes place. The above-described construction of the oil burner is widely known in the art.

Now, an embodiment of a discharge-type ignition device according to the present invention will be described hereinafter with reference to FIGS. 1 to 5.

A discharge-type ignition device of the illustrated embodiment includes a discharge electrode means 34 comprising a pair of discharge electrodes or a first discharge electrode 34*a* and a second discharge electrode 34*b*. The first and second discharge electrodes 34*a* and 34*b* are arranged in a manner to be opposite to a side surface of the wick 26 and/or an upper end thereof. In the illustrated embodiment, the first discharge electrode 34*a* is a positive electrode and the second discharge electrode 34*b* is a negative electrode. Also, in the illustrated embodiment, the first discharge electrode 34*a* and second discharge electrode 34*b* are arranged in proximity to the side surface of the wick 26 and opposite to an upper end surface of the wick with a gap being defined therebetween, respectively, when the wick 26 is raised to a normal combustion position. The second discharge electrode 34*b* is preferably arranged in proximity to the upper end of the wick 26 when it is raised to an uppermost position defined beyond the combustion position.

The ignition device of the illustrated embodiment also includes an ignition knob 36 vertically movably arranged and operatively engaged with a lever 38 provided for rotating the wick operating shaft 30 and an ignition switch 40 electrically connected to the discharge electrode means 34 to selectively feed it with electricity. In the illustrated embodiment, the ignition knob 36 is provided thereon with an arm-like switch actuator 42, so that downward movement of the ignition knob 36 may permit the switch actuator 42 to actuate the ignition switch 40. For this purpose, the discharge-type ignition device may be so constructed that the ignition switch 40 may be turned on in the course of upward movement of the wick 26. Such construction permits ignition of the wick 26 to be carried out at any appropriate position of the wick which is not fixed. The ignition knob 36 is connected to one end of a coiled compression spring 44, resulting in being constantly biased toward an original position thereof or in an upward direction as indicted at phantom lines in FIG. 2 and solid lines in FIG. 3 when it is moved to a wick ignition position. The other end of the spring 44 may be connected to any suitable portion of a body side of the oil burner. Alternatively it is connected to a base plate 45 of the ignition device.

In addition, the discharge-type ignition device of the illustrated embodiment includes a rotation plate 46 fitted on the wick operating shaft 30 so as to be rotated about the shaft 30. The rotation plate 46 is provided with a holding section 48 for securely engaging the lever 38 and rotation plate 46 with each other so as to permit both to be actuated in association with each other. Also, the rotation plate 46 is provided with a lock section 50 which is adapted to be selectively engaged with the body side of the oil burner or the base plate 45 of the ignition device to lock the wick at the combustion position, when the wick 26 is raised to the combustion position through rotation of the wick operating shaft 30. In the illustrated embodiment, the lock section 50 is engaged with a stopper 52 of a vibration sensing means 54 which may be constructed in a manner widely known in the art. The lock section 50 functions to lock the rotation plate 46 when it is engaged with the stopper 52 of the vibration sensing means 54. Thus, it will be noted that the lock section 50 defines the combustion position. The lock section 50 may comprise a part of a cutout 56 formed at a periphery of the rotation plate 46. More particularly, in the illustrated embodiment, the lock section 50 comprises a front side surface of the cutout 56 defined on the basis of rotation of the rotation plate 46 in a wick raising direction opposite to a direction indicated at an arrow 58.

Figure 2:
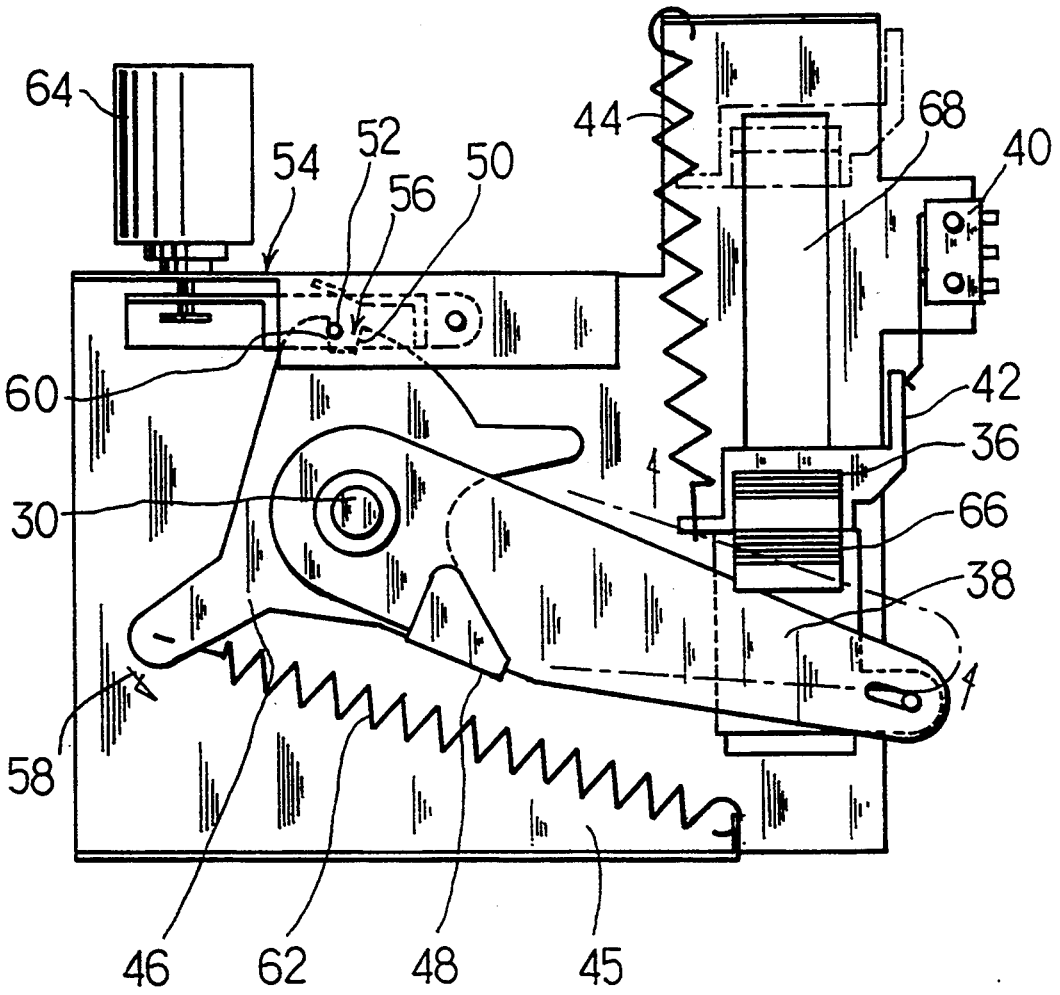
FIG. 2 is a front elevation view showing an embodiment of a discharge-type ignition device for an oil burner according to the present invention which is at a wick ignition position.

Further, the discharge-type ignition device of the illustrated embodiment includes a rotation stopper 60 for stopping further rotation of the wick operating shaft 30 in the wick raising direction to prevent further raising of the wick when the wick is raised to an uppermost position defined somewhat beyond or above the normal combustion position. In the illustrated embodiment, the rotation stopper 60 comprises a rear side surface of the cutout 56 defined on the basis of rotation of the rotation plate 46 in the wick raising direction opposite to the direction indicated at the arrow 58. Thus, it will be noted that the rotation stopper 60 defines the uppermost position. In FIG. 2, the wick is raised to the uppermost position through the wick operating shaft 30, resulting in the rotation stopper 60 being abutted against the stopper 52 of the vibration sensing means 54, to thereby prevent further raising of the wick 26 beyond the uppermost position. Thus, the rotation stopper 60 is defined opposite to the lock section 50 of the rotation plate 46. Alternatively, the rotation stopper 60 may comprise a member engaged with the lever 38 to lock it when the wick is raised to the uppermost position.

Reference numeral 62 designates a wick lowering spring for constantly biasing the rotation plate 46 in a wick lowering direction indicated at the arrow 58. For this purpose, the wick lowering spring 62 is connected at one end thereof to the rotation plate 46 and at the other end thereof to the base plate 45 of the ignition device. The wick lowering spring 62 acts to forcibly rotate the rotation plate 46 and therefore the wick operating shaft 30 in the wick lowering direction through the holding section 48. Normally, the lock section 50 of the rotation plate 46 is engaged with the stopper 52 of the vibration sensing means 54 to prevent the rotation plate 46 from being rotated due to elastic force of the wick lowering spring 62.

The vibration sensing means 54 includes a vibration sensing weight 64 which is adapted to be actuated to release engagement between the stopper 52 of the vibration sensing means 54 and the lock section 50 of the rotation plate 46 when vibration of a predetermined level or more is applied thereto, so that the wick 26 may be forcibly lowered to a fire-extinguishing position through the rotation plate 46, lever 38 and wick vertically moving shaft 30 due to elastic force of the spring 62.

Reference numeral 66 designates a wick operating or vertically moving knob which may be arranged independent from the ignition knob 36 so as to operate or vertically move the wick 26. In the illustrated embodiment, it is disposed below the ignition knob 36 in a manner to be in proximity thereto, so that the ignition operation and wick vertically moving operation may be carried out through the ignition knob 36 and wick operating knob 66, respectively. The wick operating knob 66 is downwardly moved with the ignition knob 36 when the ignition operation is carried out. Alternatively, the wick operating knob 66 may be eliminated, wherein the ignition knob may act also as the wick operating knob. In this instance, both operations may be carried out through only the ignition knob. The wick operating shaft 30, ignition knob 36 and the wick operating knob 66 are mounted on the base plate 45. The base plate 45 is provided with a slide aperture 68, along which the knobs 36 and 66 are vertically moved. Reference numeral 69 (FIG. 1) designate a wick drive lever for converting rotation of the wick operating shaft 30 into a vertical movement of the wick 26.

Now, the manner of operation of the discharge-type ignition device of the illustrated embodiment constructed as described above will be described hereinafter.

When the ignition knob 36 is downwardly moved to rotate the wick operating shaft 30 in the wick raising direction, the wick operating shaft 30 raises or upwardly moves the wick 26 until the rotation stopper 60 is abutted against the stopper 52 of the vibration sensing means 54, so that the wick is raised to the uppermost position, resulting in an upper end of the wick 26 being projected upwardly from the space of the wick receiving cylinder structure or between the inner cylindrical member 22 and the outer cylindrical member 24, during which operation of the ignition knob 36 permits the ignition switch 40 to be turned on. This results in spark discharge being generated without interruption between the discharge electrodes **34*a* and 34*b* in the course of upward movement of the wick 26, so that ignition of the wick may be accomplished when a relative position between the wick 26 and the positive discharge electrode 34*a*** is rendered optimum to the ignition.

Figure 3:
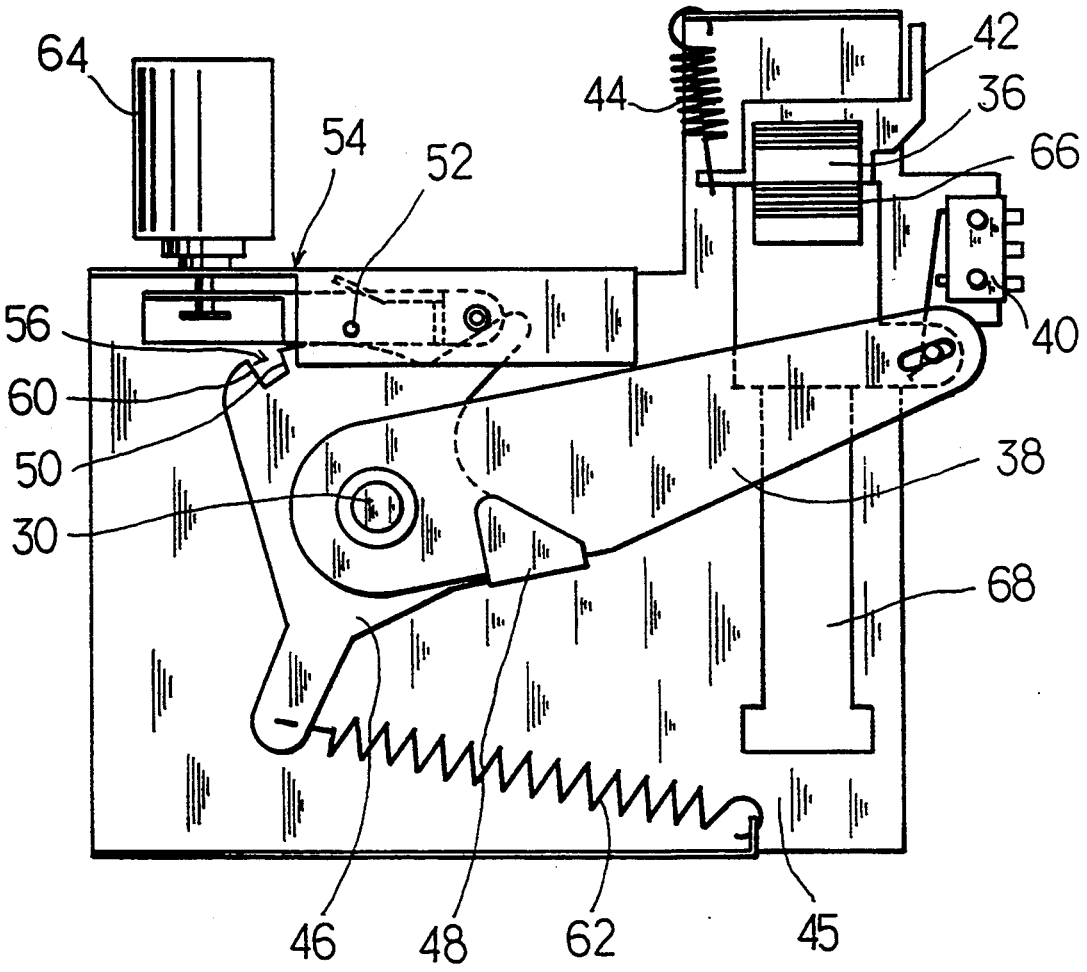
FIG. 3 is a front elevation view of the discharge-type ignition device shown in FIG. 2 which is at a fire-extinguishing position.
Figure 4:
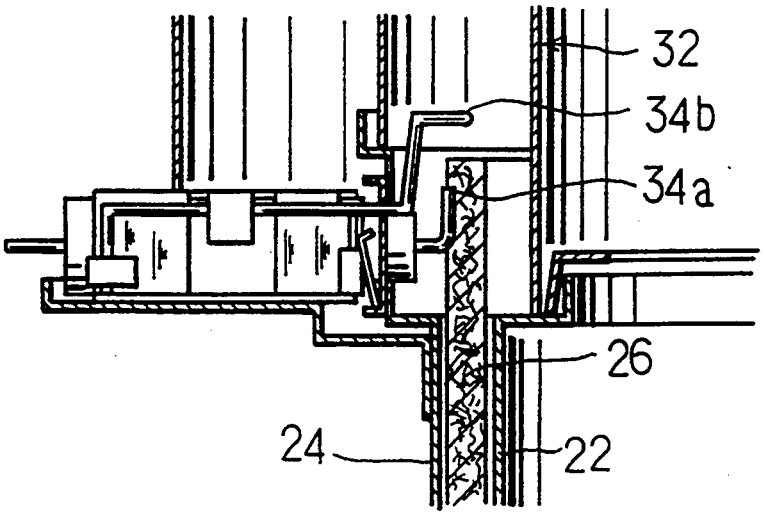
FIG. 4 is a fragmentary enlarged sectional view showing an essential part of a discharge electrode means in the discharge-type ignition device shown in FIG. 2.
Figure 5:
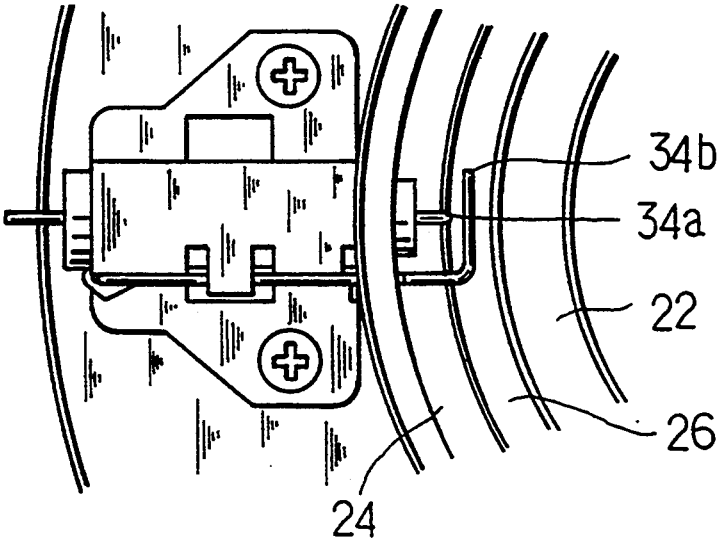
FIG. 5 is a plan view of the discharge electrode means shown in FIG. 4.

The ignition knob 36 is provided separate from the lever 38 for rotating the wick operating shaft 30; so that when the ignition knob 36 is released from a hand of an operator after ignition of the wick 26, it is released from the lever 38 by the compression spring 44, resulting in being returned to an original position thereof as shown in FIG. 3. Concurrently, the ignition knob 36 turns off the ignition switch 40 to stop the spark discharge and the ignited wick 26 is kept at the combustion position.

The holding section 48 of the rotation plate 46 causes the rotation plate 46 to be moved with the wick operating shaft 30. Therefore, when the wick operating shaft is rotated in the wick raising direction, the rotation plate 46 is rotated against the wick lowering spring 62 through the combustion position at which the lock section 50 of the rotation plate 46 is engaged with the stopper 52 of the vibration sensing means 54 to the uppermost position at which the rotation stopper 60 is abutted against the stopper 52. Then, when the ignition knob 36 is released from a hand of an operator, the wick lowering spring 62 causes the rotation plate 46 to be somewhat returned to the position at which the lock section 50 is engaged with the stopper 52 of the vibration sensing means 54, so that the wick 26 may be moved to the normal combustion position, resulting in combustion of the oil burner being continued. Thus, the wick 26 is constantly moved to the uppermost position beyond the combustion position every time when the ignition operation takes place, therefore, it is positively and effectively ignited irrespective of a variation in height of the wick 4, deterioration of the wick, deformation of the wick and the like.

As can be seen from the foregoing, the discharge-type ignition device of the illustrated embodiment is so constructed that spark discharge between the discharge electrodes 34*a* and 34*b* is carried out in the course of upward movement of the wick 26 for the ignition and combustion, resulting in ignition of the wick being positively and effectively carried out at any optimum position irrespective of a variation in height of the wick, deterioration of the wick and the like. Also, the ignition knob 36 is arranged separate from the lever 38 for rotating the wick operating shaft 30 and the ignition knob 36 is connected to the compression spring 44 for biasing it to the original position, so that spark discharge may be interrupted during the combustion operation, to thereby accomplish the ignition with high reliability.

Further, the normal combustion position of the combustion wick 26 is kept substantially constant, however, the wick is gradually deteriorated with repeating of the combustion operation. The illustrated embodiment is so constructed that the wick is moved to the uppermost position beyond the combustion position while the ignition switch is kept turned on, every time when the ignition operation is carried out, resulting in an upper portion of the wick which is easy to be ignited entering within a spark discharge range, leading to an improvement in ignition performance.

Figure 6:
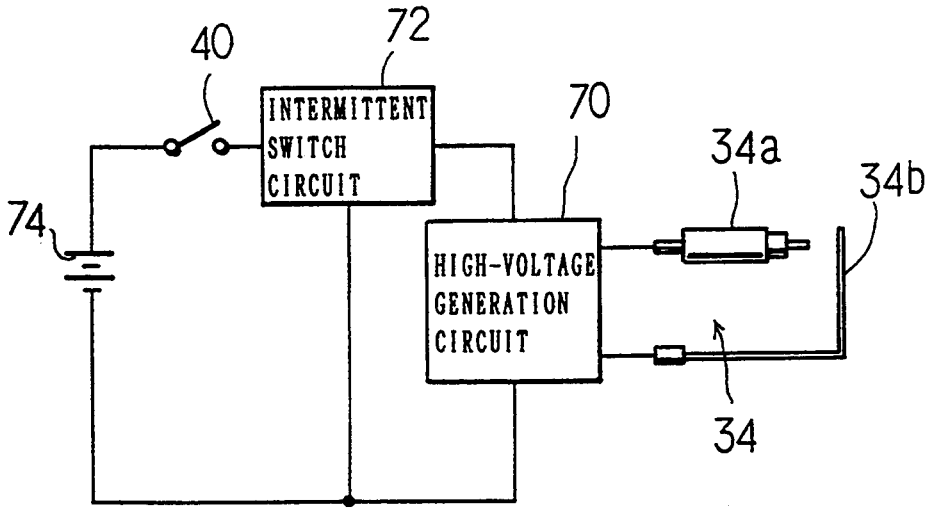
FIG. 6 is a block diagram showing an electric circuit of the discharge-type ignition device of FIG. 2.
Figure 7:
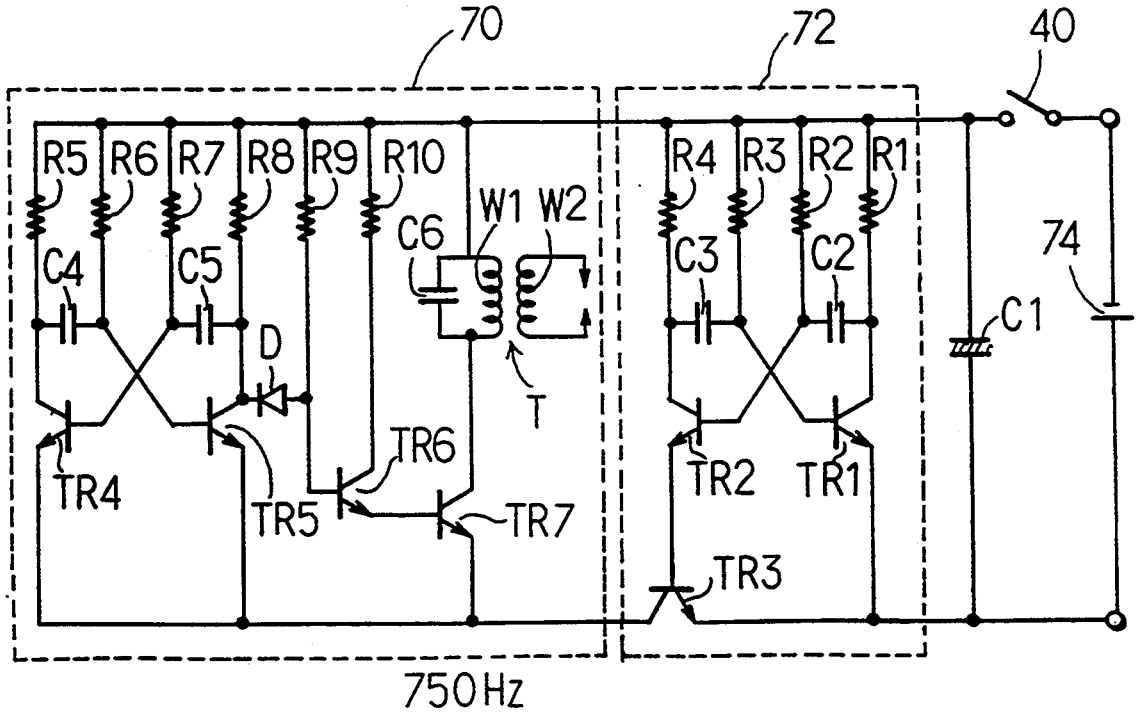
FIG. 7 is a circuit diagram of each of an intermittent switch circuit and a high-voltage generation circuit in the circuit shown in FIG. 6.

Now, an electric circuit of the discharge-type ignition device of the illustrated embodiment will be described hereinafter with reference to FIGS. 6 and 7, wherein FIG. 6 generally shows an electric circuit of the discharge ignition device of the illustrated embodiment and FIG. 7 shows an example of a circuit construction of each of a high-voltage generating circuit 70 and an intermittent switch circuit 72 in the circuit shown in FIG. 6.

Reference numeral 74 designates a battery means such as a dry cell or the like acting as a power supply for spark discharge, which battery means may be arranged so as to generate a voltage of 6 V. The ignition switch 40 is kept turned on in the course of upward movement of the wick to the uppermost position beyond the combustion position and at the uppermost position every time when the ignition operation is carried out. A period of time during which the ignition switch 40 is kept turned on may be varied by varying a length of the switch actuator 42 described above. Reference character C1 designates an electrolytic capacitor. The intermittent switch circuit 72 includes transistors TR1 to TR3, resistors R1 to R4, and capacitors C1 and C2. A transistor TR3 constitutes a semiconductor switch arranged in the middle of a connection line through which the power supply 74 is connected to the high-voltage generation circuit 70. The transistor TR3 acts as the semiconductor switch for a period of time during which the ignition switch 40 is kept turned on. Also, a signal generation circuit is provided which is adapted to feed the transistor TR3 with an on-off signal at a predetermined cycle. The signal generation circuit may be constituted by a multivibrator. In the illustrated embodiment, a value of each of the resistors R1 to R4 and capacitors C1 and C2 is so set that the transistor TR3 is kept turned on for two seconds and turned off for one second. The high voltage generation circuit 70 is kept connected to the power supply 74 during a period of time for which the transistor TR3 is kept turned on.

The high-voltage generation circuit 70 includes a signal generation circuit constituted by a multivibrator comprising resistors R5 to R8, capacitors C4 and C5, and transistors TR4 and TR5; a switching circuit comprising resistors R9 and R10, transistors TR6 and TR7, and a diode D; and a step-up transformer T and a capacitor C6. In the illustrated embodiment, a value of each of the resistors R5 to R8 and capacitors C4 and C5 is so set that an oscillation frequency of the signal generation circuit is 750 Hz. The transistors TR6 and TR7 are kept turned on for a period of time during which the transistor TR5 is kept turned off, to thereby permit a current to flow through a primary winding W1 of the transformer T. When the transistor TR5 is kept turned on, the transistors TR6 and TR7 are kept turned off, resulting in flowing of a current through the primary winding W1 of the transformer T being interrupted, leading to generation of a high voltage across a secondary winding W2 of the transformer T. The high voltage thus generated is applied between the discharge electrode 34*a* and 34*b*, so that spark discharge occurs therebetween.

In the illustrated embodiment, spark discharge between the discharge electrodes 34*a* and 34*b* is repeated for a period of time during which the transistor TR3 of the intermittent circuit 8 is kept turned on and is interrupted for a period of time during which it is kept turned off.

Also, in the illustrated embodiment, the second discharge electrode 34*b* may be grounded. At least one of the discharge electrodes 34*a* and 34*b* may be arranged so as to be contacted with or positioned in the wick when the wick is upwardly moved to the combustion position.

Figure 8:
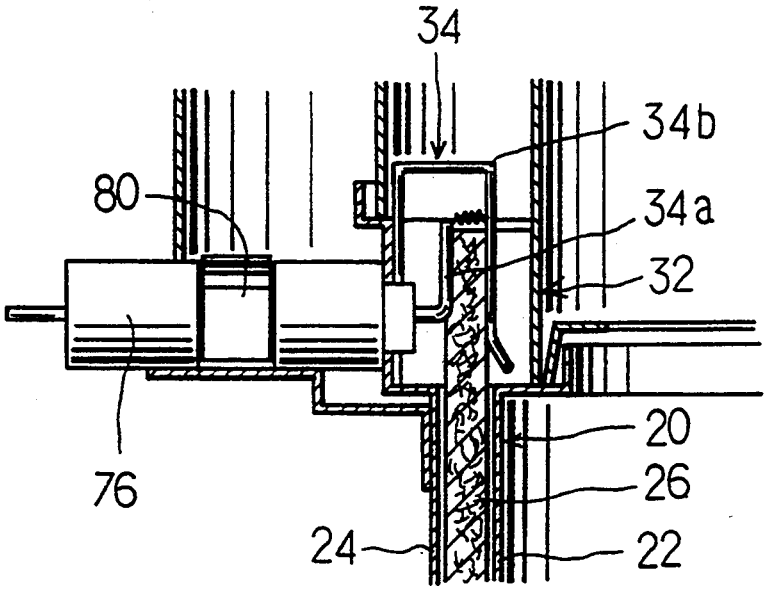
FIG. 8 is a fragmentary sectional view showing a modification of a discharge electrode means.
Figure 9:
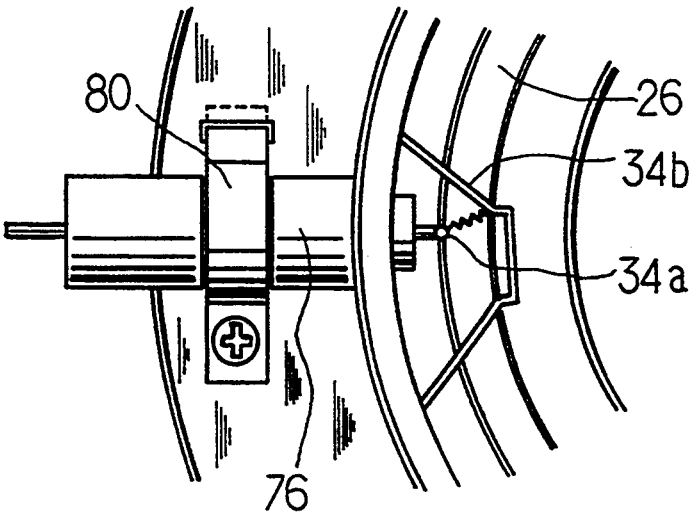
FIG. 9 is a plan view of the discharge electrode means shown in FIG. 8.

Referring now to FIGS. 8 and 9, a modification of the discharge electrode means incorporated in the discharge-type ignition device of the illustrated embodiment described above is illustrated. The modification is adapted to prevent a human body such as a hand or the like from being shocked due to careless touch with a discharge electrode means. A discharge electrode means of the modification which is generally designated at reference numeral 34 includes a first discharge electrode 34*a* mounted through an insulator 76 mounted on a collar of an upper end of an outer cylindrical member 24 of a wick receiving cylinder structure 20. The first discharge electrode 34*a* is arranged so as to be opposite to a side surface of a wick 26 or an upper end thereof when an upper portion of the wick is upwardly projected from the wick receiving cylinder structure due to upward movement of the wick for ignition.

The discharge electrode means 34 also includes a second discharge electrode 34*b* formed so as to surround at least one of an upper portion of the first discharge electrode 34*a* and a peripheral portion thereof. For this purpose, the second discharge electrode 34*b* may be formed of a wire of, for example, about 5 mm in diameter into an inverted U-shape. Also, the second discharge electrode 34*b* thus formed is arranged in a manner to upwardly extend from the outer cylindrical member 24 of the wick receiving cylinder structure 20 while being contactedly positioned at one end thereof on the outer cylindrical member 24, bent or folded at an intermediate portion thereof so as to straddle the upper portion of the wick 26, and contacted at the other end thereof with an inner surface of the wick 26 when it is raised to the combustion position. Such formation and arrangement of the wick 26 permit spark discharge to occur at the upper portion of the wick 26 surrounded by the second discharge electrode 34*b* as shown in FIGS. 8 and 9, so that a human body such as a hand or the like may be effectively prevented from touching both discharge electrodes 34*a* and 34*b* even when the ignition switch is turned on by mistake or carelessly, for example, during cleaning of the ignition device. Thus, the discharge electrode means of the modification effectively prevents a human body from being shocked due to the touch with the electrodes.

Also, the modification is so constructed that at least one of the discharge electrodes is arranged so as to be contacted with the wick when it is raised to the combustion position. Such construction permits a distance between the discharge electrode means and the wick 26 to be kept substantially constant, to thereby ensure smooth ignition of the wick.

The remaining part of the modification may be constructed in substantially the same manner as the discharge electrode means in the above-described embodiment.

Figure 10:
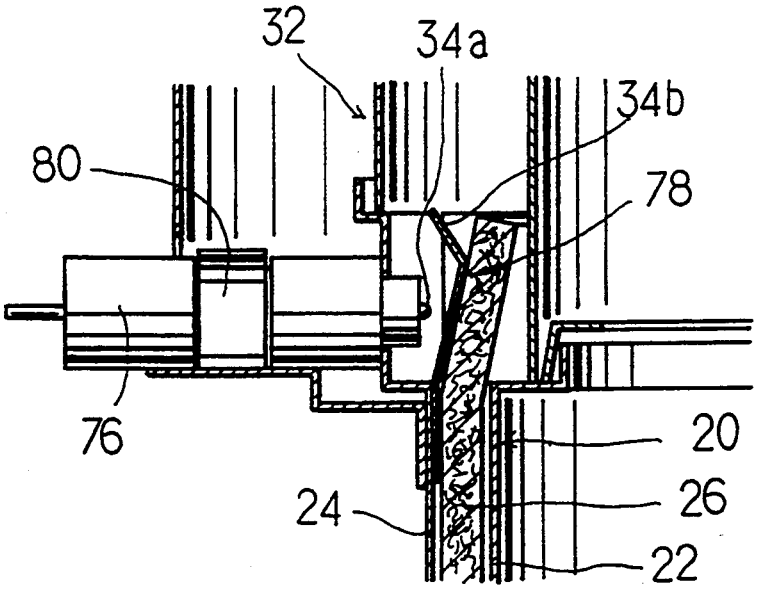
FIG. 10 is a fragmentary sectional view showing another modification of a discharge electrode means.
Figure 11:
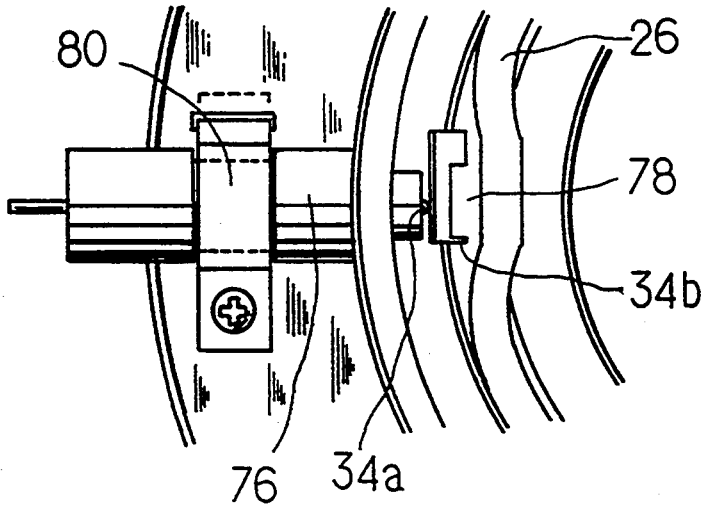
FIG. 11 is a plan view of the discharge electrode means shown in FIG. 10.

Referring now to FIGS. 10 and 11, another modification of the discharge electrode means is illustrated. A second discharge electrode **34*b* is formed of a thin plate material and arranged in a manner to be extended from below a first discharge electrode 34*a*. The second discharge electrode 34*b* is formed at a portion thereof opposite to the first discharge electrode 34*a* with an aperture 78. Then, the second discharge electrode 34*b* is is bent at an upper portion toward the first discharge electrode 34*a* while being kept contacted therewith. Such formation and arrangement permit the second discharge electrode 34*a* to surround a periphery of the first discharge electrode 34*a***. Thus, it will be noted that the modification exhibits the same advantage as the first modification described above.

Figure 12:
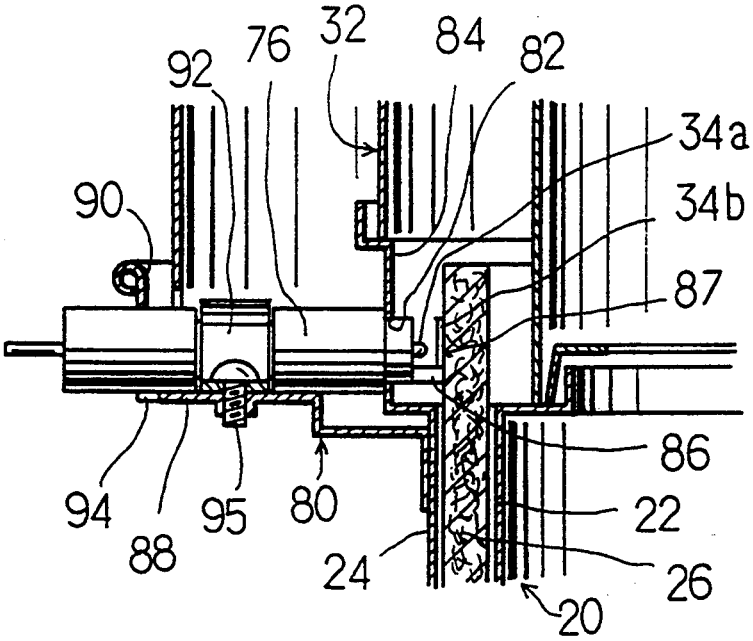
FIG. 12 is a fragmentary sectional view showing a further modification of a discharge electrode means.
Figure 13:
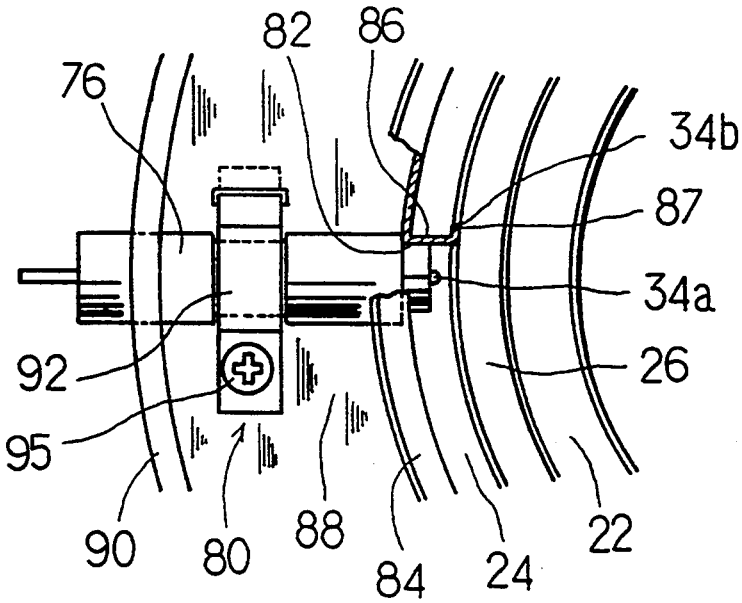
FIG. 13 is a plan view of the discharge electrode means shown in FIG. 12.

Referring now to FIGS. 12 and 13, a further modification of the discharge electrode means is illustrated. A discharge electrode means of the illustrated modification which is generally designated at reference numeral 34 includes a first discharge electrode **34*a* mounted on a radiation plate 80 provided on an outer cylindrical plate 24 of a wick receiving cylinder structure 20. The first discharge electrode 34*a* is so arranged that a distal end thereof is opposite to a side surface of an upper portion of a wick 26 through a through-hole 82 formed at an upper edge section 84 of the outer cylindrical member 24 when the wick 26 is raised to the combustion position. The upper edge section 84 is arranged so as to be positioned above an upper end of the inner cylindrical member 22 and horizontally outwardly spaced from the wick 26. The through-hole 82 is formed by cutting out a part of the upper section 84 of the outer cylindrical member 24, so that a cutout element 86 is formed at the upper edge section 84. The discharge electrode means 34 also includes a second discharge electrode 34*b* arranged opposite to the first discharge electrode 34*a*. The second discharge electrode 34*b* is grounded at one end thereof through the outer cylindrical member 24. Arrangement of the second discharge electrode 34*b* in a manner opposite to the first discharge electrode 34*a* may be carried out by horizontally extending the above-described cutout element 86 toward the wick and bending a distal end portion 87 of the cutout element 86 so as to vertically extend therefrom. This permits the distal end portion 87 to act as the second discharge electrode 34*b***.

The first discharge electrode **34*a* may be tightly fitted in the through-hole 82 of the upper end section 84 of the outer cylindrical member 24 through the insulator 76. The radiation plate 80 is arranged so as to outwardly extend from below the upper edge section 84 of the outer cylindrical member 24, resulting in heat of the outer cylindrical member 24 being outwardly discharged through the radiation plate. Also, the radiation plate 80 acts to prevent a side wing blowing against the oil burner from adversely affecting both ignition and combustion operations. For this purpose, the radiation plate 80 is formed into an annular dish-like shape, resulting in including a horizontal section 88 and a vertical section 90 formed at an outer periphery of the horizontal section 88. The insulator 76 may be supported on the horizontal section 88 of the radiation plate 80. Alternatively, the insulator may be securely mounted on the horizontal section 88 by means of a band 92. The vertical section 90 of the radiation plate 80 is formed with a through-hole 94 in a manner to be positionally aligned with the through-hole 82 of the outer cylindrical member 24, so that the first discharge electrode 34*a* may be closely inserted through the through-holes 82 and 94. Such construction further prevents a side wind blowing against the oil burner from adversely affecting both ignition operation and combustion operation, because the insulator tightly fitted in the through-holes 82 and 94 prevents the wind from blowing therethrough. Reference numeral 95 designates a screw for fixing the insulator 76 on the horizontal section 88 of the radiation plate 80**.

Thus, the modification effectively prevents a side wind blowing against the oil burner from adversely affecting both ignition operation and combustion operation. Also, the cutout element 86 of the upper edge section 84 of the outer cylindrical member 24 of the wick receiving cylinder structure 20 may is constructed so as to act as the second discharge electrode, resulting in a construction of the ignition device being simplified, leading to a decrease in cost.

Figure 14:
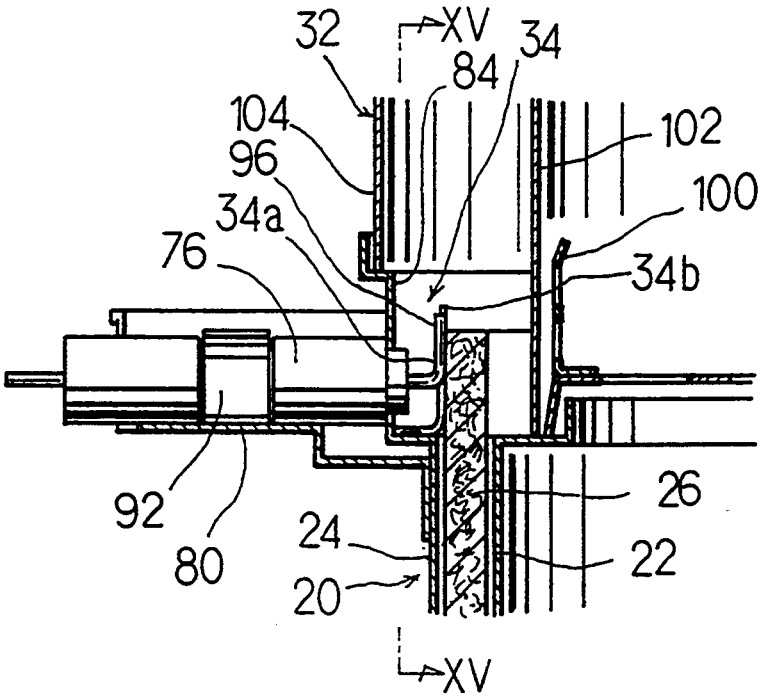
FIG. 14 is a fragmentary sectional view showing still another modification of a discharge electrode means.
Figure 15:
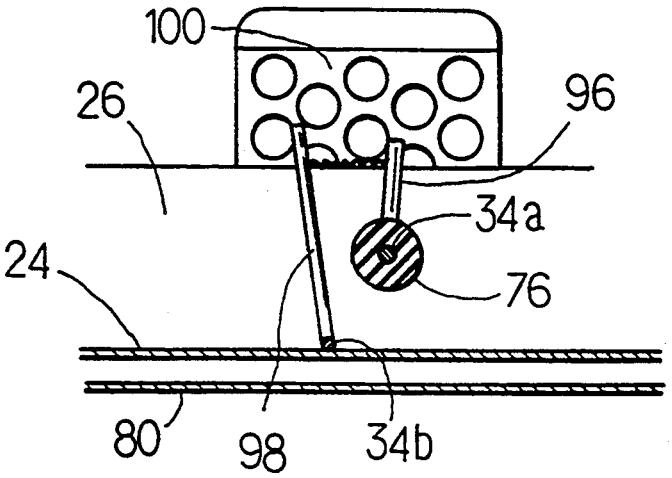
FIG. 15 is a plan view of the discharge electrode means shown in FIG. 14.

Referring now to FIGS. 14 and 15, still another modification of the discharge electrode means is illustrated. In the illustrated modification, an outer cylindrical member 24 and and inner cylindrical member 22 are formed so as to be different in height of an upper end thereof from each other. One of the outer and inner cylindrical members of which the upper end has a larger height is mounted thereon with a first discharge electrode **34*a* of a discharge electrode means 34 through an insulator 76. In the modification, the outer cylindrical member 24 is formed so as to upwardly extend at the upper end thereof beyond the inner cylindrical member 22**.

More particularly, the first discharge electrode **34*a* of the discharge electrode means 34 is mounted through an insulator 76 on an upper edge portion 84 of the outer cylindrical member 24 of a wick receiving cylinder structure 20. The first discharge electrode 34*a* is arranged so as to extend toward a wick 26. Also, the first discharge electrode 34*a* is vertically bent at a distal end portion thereof, resulting in being formed with a vertically extending parallel section 96 arranged in parallel to the wick 26 when it is raised to a combustion position. The discharge electrode means 34 also includes a second discharge electrode 34*b* mounted on the outer cylindrical member 24 in proximity to the first discharge electrode 34*a*. The second discharge electrode 34*b* is likewise arranged so as to extend toward the wick 26. Also, the second discharge electrode 34*b* is bent at a distal end thereof, to thereby be formed with a vertically extending parallel section 98 arranged in parallel to the wick 26 when it is raised to a combustion position, as well as in parallel to the vertically extending parallel section 96 of the first discharge electrode 34*a***.

In the illustrated modification, the parallel sections 96 and 98 are formed so as to upwardly extend. However, they may be arranged so as to downwardly extend.

At least one of the parallel sections 96 and 98 of the first and second discharge electrodes 34*a* and 34*b* is preferably arranged so as to be contacted with the wick 26 or positioned therein. Also, the parallel sections are preferably upwardly enlarged or spread.

Reference numeral 100 designates a guard which is formed so as to upwardly extend beyond the first and second discharge electrodes 34*a* and 34*b*. The guard 100, when the discharge electrode means 34 is disposed between the outer cylindrical member 24 and the wick 26, is arranged inside the wick 26. In this instance, the guard 100 is inside an inner cylinder 102 of a combustion cylinder construction. Whereas, it is arranged between the outer cylindrical member 24 and the wick 26 when the discharge electrode means is disposed inside the wick 26. In this instance, the guard 100 is arranged outside an outer cylinder 104 of the combustion cylinder construction 32. The guard 100 is conveniently made of a punched plate. The guard 100 serves as a protective means for preventing a human body such as a hand or the like from touching the discharge electrode means 34 by mistake during cleaning of the ignition device or the like.

As described above, the ignition device of the illustrated modification is so constructed that the vertically extending parallel sections 96 and 98 of the discharge electrodes 34*a* and 34*b* each are arranged so as to be contacted with or positioned in the wick. Such construction ensures positive ignition of the wick. Also, arrangement of the guard 100 effectively prevents a human body from being shocked due to touch with the discharge electrode means.

While a preferred embodiment of the invention has been described with a certain degree of particularity with reference to the drawing, obvious modifications and variations are possible in light of the above teachings. It is therefore to be understood that within the scope of the appended claims, the invention may be practiced otherwise than as specifically described.

What is claimed is:

1. A discharge-type ignition device for an oil burner, comprising:

a wick receiving cylinder structure including an inner cylindrical member and an outer cylindrical member arranged so as to be spaced from each other with a space being defined therebetween;

a wick arranged in said space of said wick receiving cylinder structure so as to be vertically movable;

a wick operating shaft rotated for vertically moving said wick;

a discharge electrode means including a first discharge electrode and a second discharge electrode which are arranged for generating spark discharge therebetween sufficient to ignite a raised portion of said wick raised so as to upwardly extend from said space of said wick receiving cylinder structure;

an ignition knob for rotating said wick operating shaft in a wick raising direction; and an ignition switch operated depending on actuation of said ignition knob;

said ignition switch being turned off when said ignition knob is moved to a wick lowered position and turned on in the course of an upward movement of said wick;

one of said first and second discharge electrodes being arranged in a manner to be in substantial contact with said wick during said upward movement thereof;

and said ignition switch causing said discharge electrode means to carry out said spark discharge during said upward movement of said wick.

2. A discharge-type ignition device as defined in claim 1, wherein said ignition knob is provided separate from said wick operating shaft;

said ignition knob turns on said ignition switch at a combustion position at which combustion is carried out as well as in the course of said upward movement of said wick; and said ignition knob is constantly urged toward an original position.

3. A discharge-type ignition device as defined in claim 2, further comprising a rotation stopper for preventing said wick operating shaft from being rotated beyond an uppermost position defined beyond said combustion position; and a rotation plate fittedly mounted on said wick operating shaft so as to be rotatable about said wick operating shaft;

said rotation stopper being arranged in association with one of said wick operating shaft and rotation plate;

said rotation plate being formed with a holding section for holding said rotation plate on said wick operating shaft to move said rotation plate with said wick operating shaft and a lock section for locking said rotation plate at said combustion position;

said rotation plate having connected thereto a wick lowering spring for biasing said rotation plate locked at said combustion position in a wick lowering direction;

and said wick operating shaft being rotated to said uppermost position beyond said combustion position every time when an ignition operation is carried out, during which said spark discharge is generated.

4. A discharge-type ignition device as defined in claim 2, wherein at least one of said first and second discharge electrodes is arranged so as to be constantly in substantial contact with said wick when said wick is positioned at the combustion position.

5. A discharge-type ignition device as defined in claim 1, further comprising a high-voltage generation circuit for applying, between said first discharge electrode and said second discharge electrode, a high voltage sufficient to permit spark discharge to be generated between said discharge electrodes;

a battery means for feeding a DC power to said high-voltage generation circuit through said ignition switch; and an intermittent switch circuit arranged between said ignition switch and said high-voltage generation circuit so as to be operated at a predetermined cycle for a period of time during which said ignition switch is kept turned on, to thereby permit a current to be intermittently fed from said battery means to said high-voltage generation circuit.

6. A discharge-type ignition device as defined in claim 5, wherein said intermittent switch circuit includes a semiconductor switch arranged in the middle of a connection line through which said battery means and high-voltage generation circuit are connected to each other and a signal generation circuit for outputting an on-off signal to said semiconductor switch at a predetermined cycle for a period of time during which said ignition switch is kept turned on.

7. A discharge-type ignition device as defined in claim 1, wherein at least one of said first and second discharge electrodes is arranged so as to be positioned in the wick when the wick is positioned at the combustion position.

8. A discharge-type ignition device as defined in claim 1, wherein said second discharge electrode is arranged so as to surround at least one of an upper portion of said first discharge electrode and a periphery thereof;

at least one of said discharge electrodes being arranged so as to be constantly in substantial contact with said raised portion of said wick.

9. A discharge-type ignition device as defined in claim 1, wherein said outer cylindrical member of said wick receiving cylinder structure is provided with an upper edge section;

said upper edge section being formed with a through-hole by cutting out a part thereof, resulting in a cutout element being formed at said upper edge section;

and said cutout element horizontally extending toward said wick and being bent at a distal end portion thereof so as to vertically extend, so that said distal end portion may act as said second discharge electrode.

10. A discharge-type ignition device as defined in claim 1, wherein said outer cylindrical member and inner cylindrical member are arranged so as to be different in height at an upper end thereof from each other;

one of said outer and inner cylindrical members of which the upper end has a larger height having mounted thereon said first discharge electrode through an insulator;

said first discharge electrode being formed at a distal end thereof with a vertically extending parallel section which is parallel to said wick;

and said second discharge electrode being formed at a distal end thereof with a vertically extending parallel section which is parallel to said wick and said parallel section of said first discharge electrode.

11. A discharge-type ignition device as defined in claim 10, wherein at least one of said parallel sections of said first and second discharge electrodes is arranged so as to be constantly in substantial contact with said raised portion of said wick.

12. A discharge-type ignition device as defined in claim 10, wherein at least one of said parallel sections of said first and second discharge electrodes is arranged so as to be positioned in said raised portion of said wick.

13. A discharge-type ignition device as defined in claim 11, wherein said parallel sections of said first and second discharge electrodes are formed to upwardly extend while being upwardly enlarged.

14. A discharge-type ignition device as defined in claim 11, further comprising a guard arranged in a manner to be opposite to said discharge electrode means with said wick being interposed between said guard and said discharge electrode means.

15. A discharge-type ignition device as defined in claim 12, wherein said parallel sections of said first and second discharge electrodes are formed to upwardly extend while being upwardly enlarged.

16. A discharge-type ignition device as defined in claim 12, further comprising a guard arranged in a manner to be opposite to said discharge electrode means with said wick being interposed between said guard and said discharge electrode means.

17. A discharge-type ignition device as defined in claim 1, wherein at least one of said first and second discharge electrodes is arranged so as to be constantly in substantial contact with said raised portion of said wick.

18. A discharge-type ignition device as defined in claim 1, wherein at least one of said first and second discharge electrodes is arranged so as to be positioned in said raised portion of said wick.

* * * * *